US007431358B2

(12) United States Patent
Gomes et al.

(10) Patent No.: US 7,431,358 B2
(45) Date of Patent: Oct. 7, 2008

(54) NON-METALLIC REINFORCED DOOR HANDLE ADAPTER

(75) Inventors: Francis Gomes, Jersey City, NJ (US); Paul Thom, Butler, NJ (US); Kathleen L. O'Neill, Bloomingdale, NJ (US); David Landsberger, Caldwell, NJ (US); Kurt Landsberger, Verona, NJ (US)

(73) Assignee: Bel-Art Products, Inc., Pequannock, NJ (US)

( * ) Notice: Subject to any disclaimer, the term of this patent is extended or adjusted under 35 U.S.C. 154(b) by 23 days.

(21) Appl. No.: 11/178,960

(22) Filed: Jul. 11, 2005

(65) Prior Publication Data

US 2007/0007778 A1 Jan. 11, 2007

(51) Int. Cl.
*E05B 3/00* (2006.01)

(52) U.S. Cl. ..... 292/336.3; 292/347; 292/DIG. 2

(58) Field of Classification Search ..... 292/336.3, 292/347, DIG. 2
See application file for complete search history.

(56) References Cited

U.S. PATENT DOCUMENTS 1,777,443 A * 10/1930 Mastin ..... 277/648
2,808,282 A 10/1957 Peoples
2,947,561 A 8/1960 Holden
3,471,190 A 10/1969 Wansbrough et al.
3,827,739 A 8/1974 Overholser
4,223,931 A 9/1980 Neary
4,285,536 A 8/1981 McCoy et al.
4,397,489 A 8/1983 Lind
4,403,800 A 9/1983 Ward
4,648,643 A * 3/1987 Bettger ..... 292/347
4,728,133 A 3/1988 Valley
4,993,768 A * 2/1991 Ewen ..... 294/51
5,495,641 A * 3/1996 Going et al. ..... 16/414
6,125,511 A * 10/2000 Woods ..... 16/422
6,289,557 B1 9/2001 Manson et al.
6,390,521 B1 * 5/2002 Bohlman et al. ..... 292/348
6,401,385 B1 * 6/2002 Kleinert ..... 47/44
6,722,716 B2 4/2004 Basser
6,820,457 B2 * 11/2004 Luebke et al. ..... 72/459

OTHER PUBLICATIONS

Maddock Inc. Catalog No. 0699, p. 56.

* cited by examiner

*Primary Examiner*—Gary Estremsky
(74) *Attorney, Agent, or Firm*—Lawrence G. Fridman

(57) ABSTRACT

A non-metallic adapter provided to facilitate the rotation of a doorknob is formed with a cap adapted to receive a doorknob. A lever extends outwardly from the cap. The lever is formed with an internal cavity provided with a plurality of reinforcing members separating the cavity into a plurality of substantially isolated reinforced regions.

5 Claims, 8 Drawing Sheets

NON-METALLIC REINFORCED DOOR HANDLE ADAPTER

BACKGROUND OF THE INVENTION

1. Field of the Invention

The present invention relates to door handles, and more particularly to a light weight, reinforced adapter facilitating rotation of a door knob.

2. Description of the Prior Art

The opening of a door ordinarily requires turning of the doorknob by the twist of a hand. This task is difficult for individuals with substantially limited hand dexterity because such individuals are not capable of generating a substantial gripping force with their fingers. Without assistance, handling heavy metal handles is particularly troublesome for many elderly individuals and persons suffering from common ailments such as arthritis, and those with more serious conditions such as partial paralysis, amputations, multiple sclerosis, muscular dystrophy, cerebral palsy, quadriplegia, and other disabilities.

To address this issue, government regulations require doorknobs to be formed as a lever type, so as to facilitate door opening by a person having less manual dexterity than is required to turn a conventional round knob.

Many handle-type devices fabricated out of metal have inherent limitations. First, metals having non-corrosive quality are often expensive to buy, fabricate, and assemble. Second, if a manufacturer chooses to use inexpensive metals, such metals tend to corrode which in turn creates health concerns and requires frequent maintenance or replacement. This drawback is particularly serious in hospitals, senior citizen facilities, and other places for the elderly and infirmed where health concerns are high and the budget is often low. Third, inexpensive metals are often of a high density, which results in a heavy weight of a handle and requiring a substantial torque and other forces for their operation.

Low weight handles or adapters made of non-metallic material are also known in the art. However, such devices are not very successful because they are structural imitations of their metallic counterparts. Typical handles or adapters made from non-metallic material are often unable to withstand the required torque and other forces a door handle encounters in everyday usage.

Thus, there has been a long-felt unsolved need to provide a non-metallic adapter facilitating rotation of a door knob door handle which is relatively inexpensive because of the material utilized in the manufacturing and fabrication thereof. Furthermore, there has been a need for such adapter of non-metallic construction specifically designed to withstand the torque, bending and other forces for which these type of devices are typically exposed to in their operation, and do not corrode and or interfere with the environment of hospitals, other healthcare facilities, etc.

SUMMARY OF THE INVENTION

One aspect of the invention provides a non-metallic adapter facilitating rotation of a doorknob having a supporting shaft. The adapter consists of a cap which is adapted to receive the doorknob, a lever extending outwardly from the cap and transversely to an axis thereof, and a pressure ring adapted to pass over the supporting shaft, so that the cap is adapted to be attached to the doorknob by an axial force between the ring and the cap. The lever is formed with an internal cavity provided with a plurality of reinforcing members subdividing the internal cavity into a plurality of substantially isolated reinforced regions. The lever is formed by longitudinal walls spaced from each other and a base wall interconnecting the longitudinal outer walls, whereas the internal cavity is confined by the longitudinal walls and the base wall. The lever is formed having a proximal end adjacent to the exterior surface of the cap and a closed distal end, the internal cavity extends between the proximal end and the distal end.

As to another aspect of the invention, at least one longitudinal reinforcing member extends within the internal cavity between the longitudinal walls. A plurality of transverse reinforcing members extend transversely to the longitudinal reinforcing member. A utility aperture is formed in the cavity in such a manner that the transverse reinforcing members are positioned between the utility aperture and the longitudinal outer walls. The longitudinal reinforcing member consists of proximal and distal segments separated from each other. The proximal segment extends between the exterior surface of the cap and the utility aperture, whereas the distal segment extends between the utility aperture and the distal end of the lever.

As to further aspects of the invention, the utility aperture is defined by a peripheral wall. The peripheral wall, the longitudinal reinforcing member, and the plurality of transverse reinforcing member extend from the base wall of the lever substantially through the entire width of the lever.

Still another aspect of the invention provides a non-metallic adapter facilitating rotation of a doorknob in which a pressure ring is formed having a substantially C-shaped configuration with inner and outer walls and an inner space therebetween. A plurality of stiffening members are provided within the inner space between the inner and outer walls separating the inner space of the pressure ring into a plurality of substantially isolated reinforced areas. At least one reinforcing member is disposed within the inner space between the two adjacent stiffening members, whereas the width of the reinforcing member is substantially greater than the width of the respective stiffening members.

A further aspect of the invention, the pressure ring consists of a plurality of reinforcing members disposed within the inner space of the ring. Each reinforcing member is adapted to accommodate an opening having a longitudinal axis extending along a longitudinal axis of the pressure ring.

BRIEF DESCRIPTION OF THE DRAWINGS

The foregoing summary as well as the following detailed description of the preferred embodiments of the present invention will be best understood when considered in conjunction with the drawings in which.

DESCRIPTION OF THE EMBODIMENT

Figure 1:
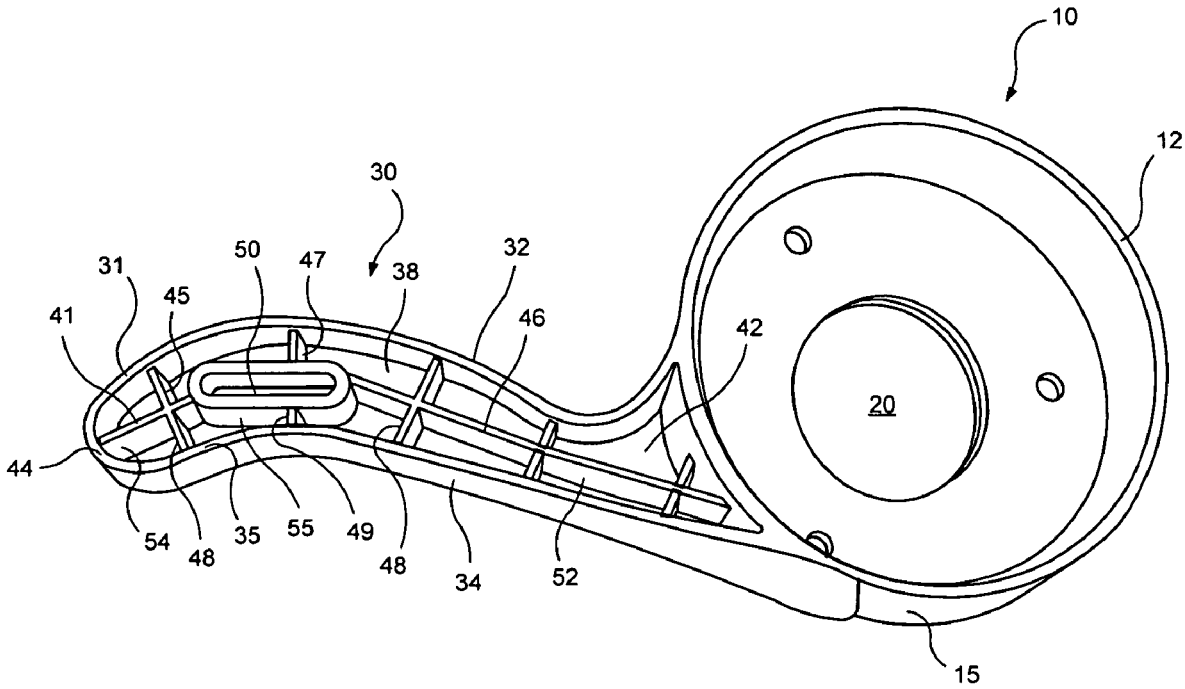
FIG. 1 shows a semi-perspective elevational view of a non-metallic door handle adapter of the invention.

Referring now to the drawings in general, and specifically to the views of FIG. 11-14, which show the adapter of an invention attached to a door knob. An adapter 10 is formed having a cap 12 configured to be positioned over the knob 18. The cap 12 is typically provided with a centered opening 20 to facilitate access to a keyhole in knob 18 if desired. Lever 30 extends outwardly from the cap 12, so as to form a unitary structure. Alternatively, the lever 30 and the cap 12 can be initially fabricated as separate elements. In such circumstances, the lever 30 may be attached to the cap 12 by an adhesive, such as an epoxy, or by any other suitable means. The axial length of the cap 12 is designed to accommodate a majority of the typically encountered knob sizes.

Turning now to FIGS. 1-4 showing the non-metallic adapter with the reinforced lever 30 in greater detail. Lever 30 is formed by the longitudinal outer walls 32 and 34 spaced from each other and a base wall 36 interconnecting the longitudinal outer walls. In this manner, to further reduce the weight of the adapter, an internal substantially hollow cavity 38 is formed with the lever, which is confined by the longitudinal walls 32 and 34 and the base wall 36. The internal cavity 38 extends between a proximal end 42, which is adjacent to the exterior surface 15 of the cap 12 and a closed distal end 44. In order to increase structural rigidity of the lever 30, at least one longitudinal reinforcing member 46 is provided within the internal cavity 38, so as to be situated substantially centrally between the longitudinal walls 32 and 34. To further enhance the strength of the lever, a plurality of transverse reinforcing members 48 extend within the internal cavity 38 transversely to the direction of the longitudinal reinforcing member 46.

A utility aperture 50 defined by a peripheral wall 55 is positioned within the internal cavity 38. In the embodiment of FIGS. 1-4 the utility aperture 50 is disposed in the vicinity of and spaced from the closed distal end 44 of the lever. However, it should be obvious that other locations of the utility aperture 50 within the internal cavity are also contemplated.

Figure 2:
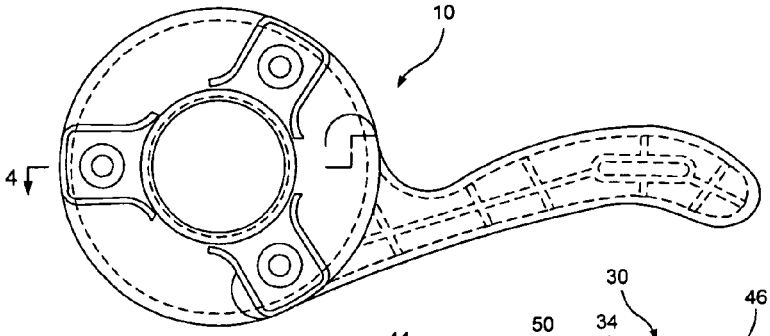
FIG. 2 is an elevational view of another side of the adapter.
Figure 3:
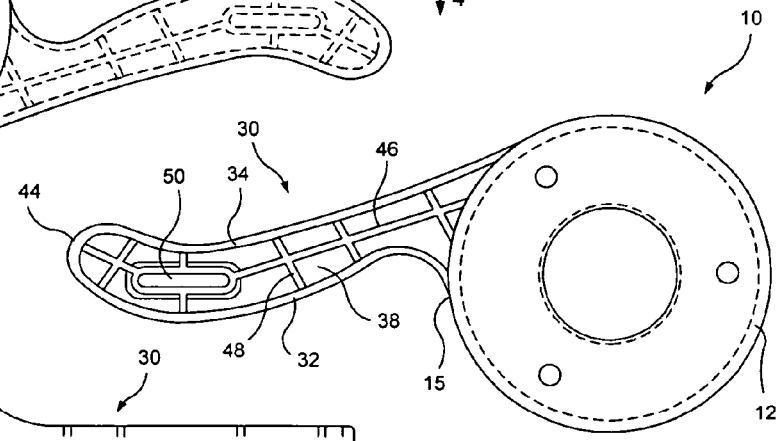
FIG. 3 is a further elevational view of the adapter.
Figure 5:
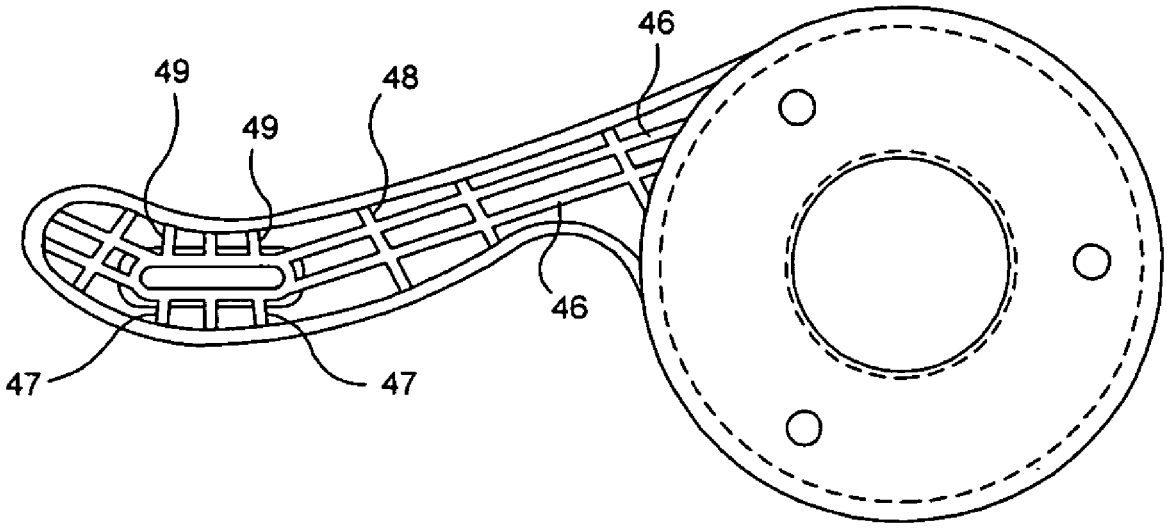
FIG. 5 is an elevational view of another embodiment of the non-metallic door handle adapter.
Figure 6:
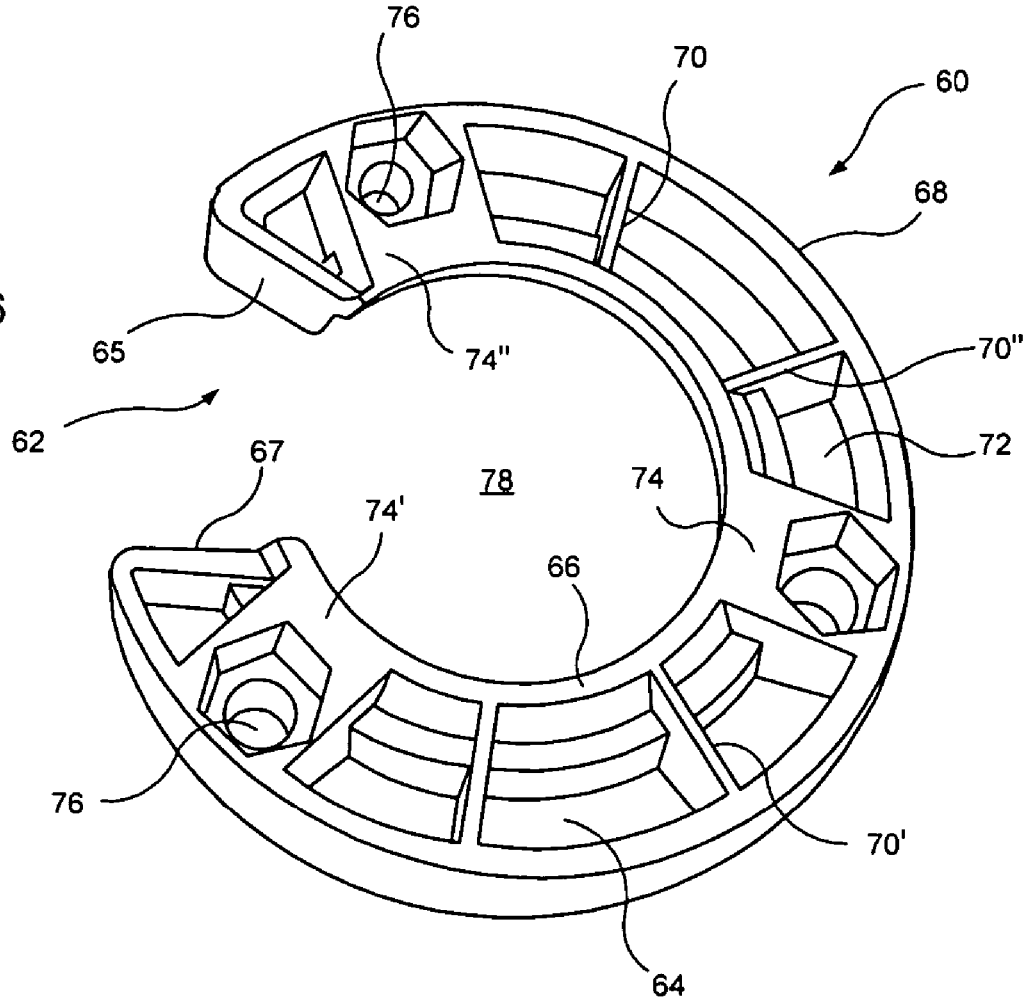
FIG. 6 is a semi-perspective view of a reinforced pressure ring.
Figure 7:
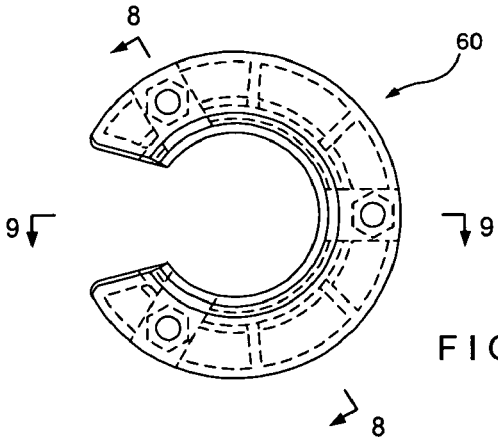
FIG. 7 is an elevational view of the pressure ring.
Figure 8:
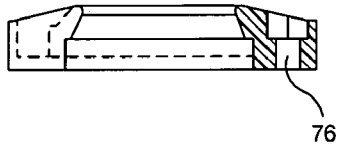
FIG. 8 is a sectional view according to section line 8-8 of FIG. 7.
Figure 9:
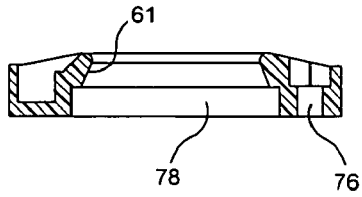
FIG. 9 is a sectional view according to section line 9-9 of FIG. 7.
Figure 10:
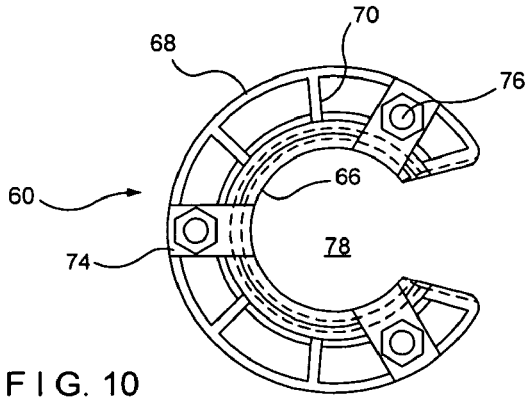
FIG. 10 is an elevational view of another side of the pressure ring.
Figure 11:
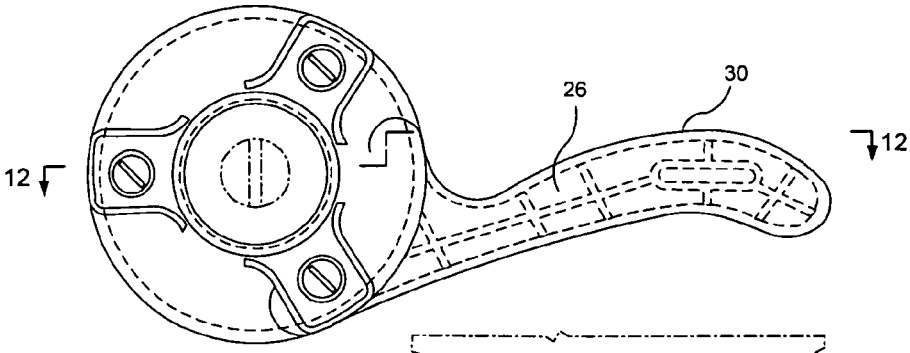
FIG. 11 is a front elevational view of the adapter in an assembled condition.

As best illustrated in FIGS. 1 and 3, the longitudinal reinforcing member 46 consists of proximal 52 and distal 54 segments separated from each other by the utility aperture 50. The proximal segment 52 extends between the exterior surface of the cap 12 and the utility aperture 50, whereas the distal segment 54 is interposed between the utility aperture 50 and the closed distal end 44. At least one transverse reinforcing member 47 is provided between the peripheral wall 55 of the utility aperture and the respective longitudinal wall 32. In a similar manner, another transverse reinforcing member 49 is provided between the peripheral wall 55 of the aperture and another longitudinal wall 34 of the lever. In the preferred embodiment of the invention, as illustrated in FIGS. 1-3, one transverse reinforcing members 47, 49 is disposed between the utility aperture and the respective longitudinal walls and the lever. On the other hand, as shown in FIG. 5, positioning of multiple transverse members 47, 49 between the utility aperture and the respective longitudinal walls is also contemplated.

Figure 4:
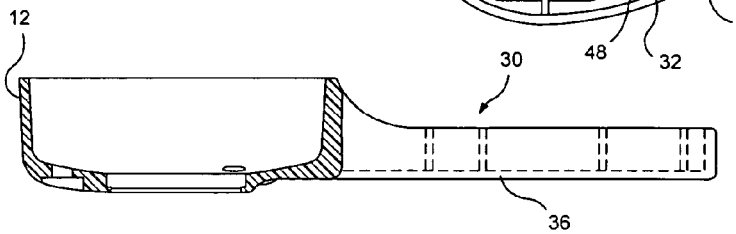
FIG. 4 is a sectional view according to section line 4-4 of FIG. 2.

As best illustrated in at least FIGS. 1 and 4, the longitudinal reinforcing member 46, the transverse reinforcing members 48, as well as the peripheral wall 55 of the utility aperture extend outwardly from the base wall 36 within the internal cavity 38 to define the axial length of the respective elements. Significantly, in order to increase the strength and rigidity of the lever structure, the axial length of the longitudinal and transverse reinforcing members 46 and 48 and the peripheral wall 55 of the utility aperture extend along a significant portion of the axial length of the longitudinal walls 32 and 34 of the reinforced lever. In this manner, the end surfaces 41 and 45 of the reinforcing members 46 and 48, respectively, can extend up to the level of the outer edges 31 and 35 of the respective outer walls 32 and 34.

Turning now to FIGS. 6-10, illustrating the pressure ring 60 which is typically formed with a cutout portion 62, so as to allow its placement over neck 17 of the knob. Thus, the ring body is defined having a substantially C-shaped configuration with a central hole 78 large enough to allow the ring to encircle a rear part of the knob 18. The pressure ring 60 is preferably formed with a tapered portion 61 which provides a radially inwardly directed force on the inner surface of the knob. A substantially hollow inner space 64 is provided between inner 66 and outer 68 walls of the ring. A plurality of stiffening members 70 extend transversely to the walls 66 and 68, so as to form a plurality of substantially isolated areas 72 within the inner space 64. As further illustrated in FIGS. 6-10, in order to increase rigidity of the ring, a plurality of reinforcing members 74 is disposed within the inner space 64. A central reinforcing member 74 is positioned between two adjacent stiffening members 70' and 70". Distal reinforcing members 74' and 74" are disposed between the respective stiffening members 70 and end walls 65 and 67 of the pressure ring 60.

Figure 12:
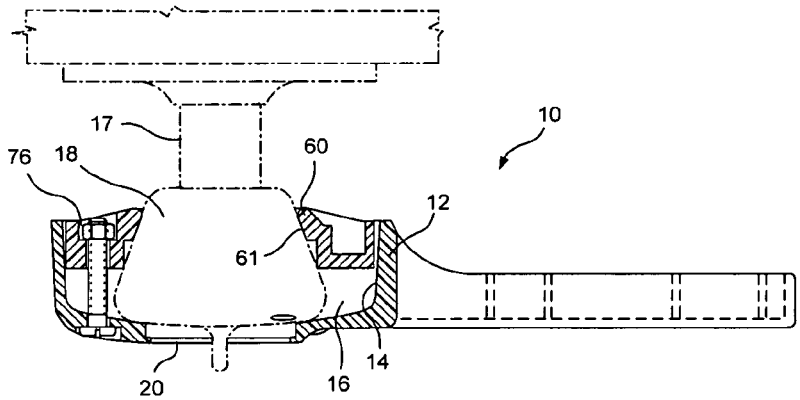
FIG. 12 is a sectional view according to section line 12-12 of FIG. 11.
Figure 13:
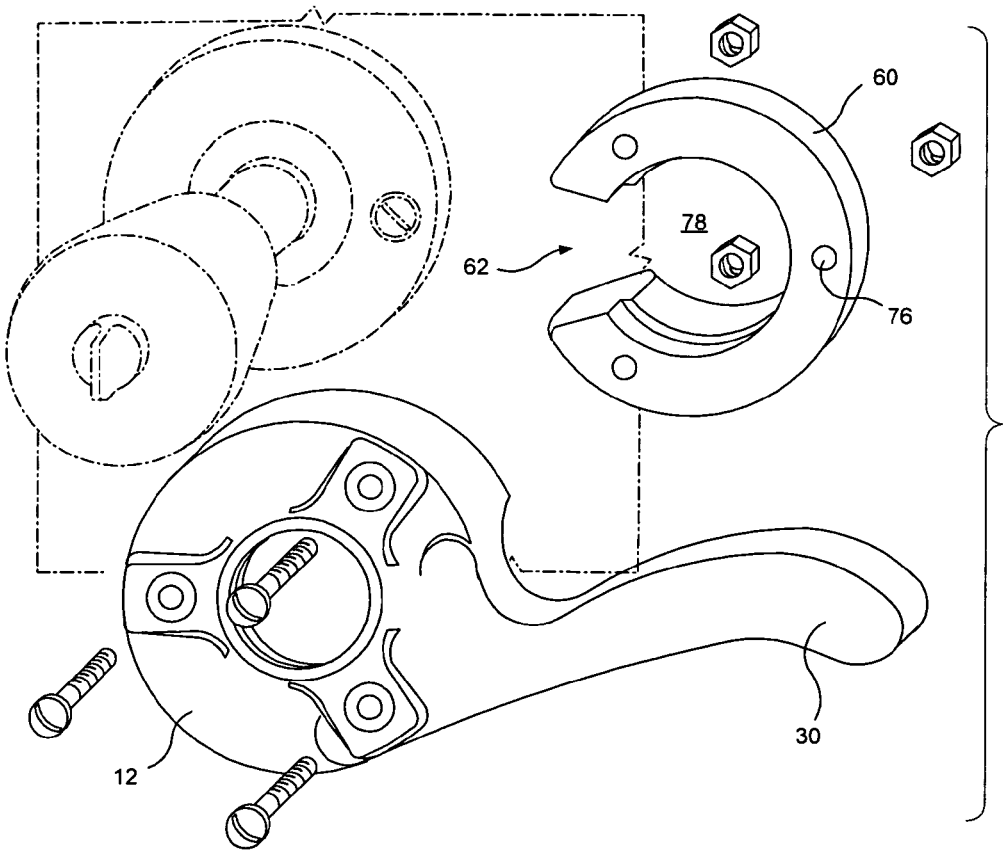
FIG. 13 shows an exploded view of the reinforced door handle adapter assembly of the invention.
Figure 14:
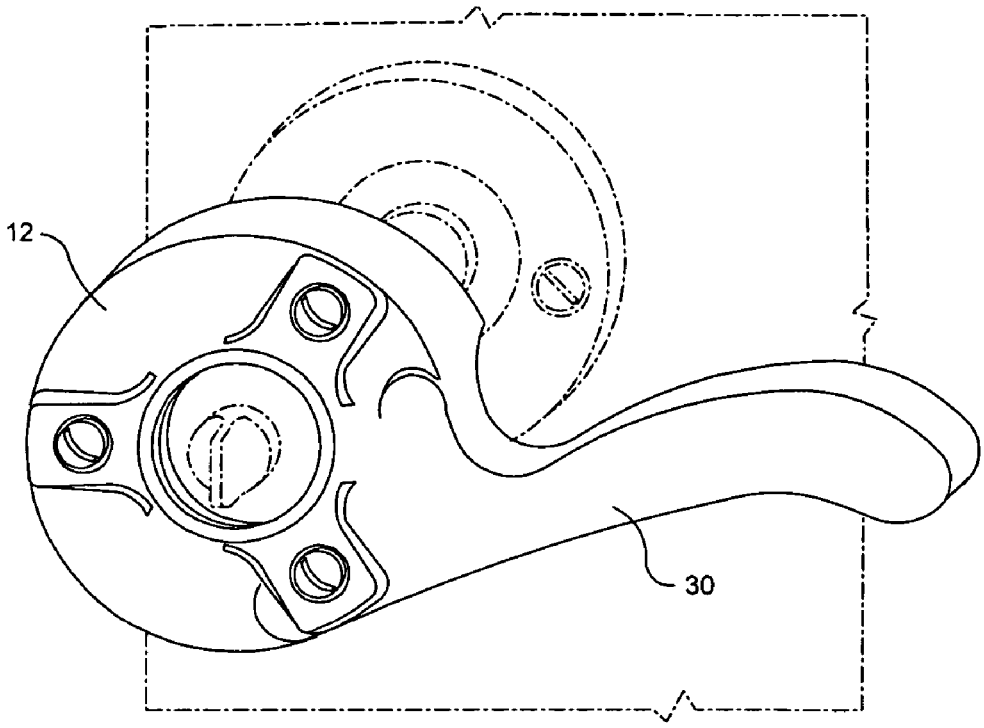
FIG. 14 is a semi-perspective view showing the door adapter in the assembled condition being attached to the doorknob.

The width, or circumferential extent, of the reinforcing members 74 is greater than the width of the respective stiffening members 70. Thus, one aperture 76 can be formed within the body of each member 74 such that a longitudinal axis of each such aperture extends along the longitudinal axis of the central opening 78 of the ring. As illustrated in FIGS. 12 and 13, the apertures 74, 76 are provided to accommodate respective fasteners in the assembled condition of the invention.

The construction of the adapter 10 of the invention is such that it can be used with many conventional cross-sectional shape of door knob as is indicated in FIGS. 10-13. The inner part of the cap 12 engages the front face of the door knob and properly positions the device relative to the door knob. In this manner, effective clamping action is achieved regardless of the particular shape or contour of the knob. Thus, an operator need not exert any gripping action on the door knob and the door-latch operating mechanism can be actuated merely by applying a downward pressure on the latch portion.

The adapter 10 of the invention is placed over the existing door knob 18 and is made of reinforced non-metallic material, such as plastic which is capable of withstanding abuse, even in a public place. More specifically, the adapter 10 can be manufactured from polymers, such as for example, elastomers including Neoprin, polyurethane, etc.

The pressure ring 60 associated with a rear surface of the knob 18, in the assembled condition of the invention, is connected to the cap 12 by means of conventional fasteners passing through the apertures 76 and the respective openings in the cap.

The adapter of the invention retains all the benefits of the existing metallic door knob, while the reinforced non-metallic lever can be inexpensively produced and installed. The adapter with the reinforced plastic lever does not corrode or create health risks, which is a pressing concern in many places where such handles are required.

Finally, the adapter of the invention can be added to any existing door handle without special knowledge on the part of the installer. Therefore, the adapter is ideal for use to retrofit public institutions and facilities. In a private home, the adapter could be quickly placed or removed from the respective doorknob as the need arises.

While a particular embodiment of the invention has been illustrated and described, it will be apparent to those skilled in the art that various changes and modifications can be made without departing from the invention, and it is intended in the appended claims to cover all such changes and modifications that fall within the true spirit and scope of the invention.

What is claimed is:

1. A non-metallic adapter facilitating rotation of a door knob having a supporting shaft, said adapter comprising:

a cap;

the cap being adapted to receive the knob;

a handle extending outwardly from the cap;

a pressure ring adapted to pass over and around the supporting shaft, the cap adapted to be frictionally attached to the knob by axial force between the ring and the cap producing a required frictional engagement; the pressure ring being formed having substantially C-shaped configuration having two end walls separated by a gap and having inner and outer walls and an inner space formed therebetween; wherein a plurality of stiffening members extends within said inner space between said inner and outer walls separating the inner space of the pressure ring into a plurality of substantially isolated areas, a plurality of reinforcing members disposed within said inner space, the width of each said reinforcing member being substantially greater than the width of the respective stiffening members; and to enhance structural strengths of the pressure ring distal reinforcing members are positioned adjacent to the respective end walls, and said reinforcing member situated in a central part of the pressure ring is disposed between two adjacent stiffening members.

2. The adapter according to claim 1, wherein each said isolated area is situated between the inner and outer walls of the pressure ring.

3. The adapter according to claim 2, further comprising a plurality of said reinforcing members disposed within the inner space of the pressure ring.

4. The adapter according to claim 1, wherein said C-shaped pressure ring further comprises a central bole, a front engaging side surrounding said central hole and facing the knob and opposite rear side thereof, a tapered portion extending within said hole between said front and rear sides, at least areas of said distal reinforcing members facing the knob form a part of the tapered portion, so as to provide better engagement and exert the additional axially directed force on the knob in the assembled condition of the adapter.

5. The adapter according to claim 4, wherein an area of said central reinforcing members facing the knob forms a part of the tapered portion, so as to provide better engagement and exert the additional axially directed force on the knob in the assembled condition of the adapter.

* * * * *